United States Patent [19]

Ebeling

[11] Patent Number: 5,029,655

[45] Date of Patent: Jul. 9, 1991

[54] DRILLING MACHINE FOR DRILLING LARGE DRILLING HOLES IN ROCK, PARTICULARLY UNDERGROUND

[75] Inventor: Wolfgang Ebeling, Hannover, Fed. Rep. of Germany

[73] Assignee: Turmag Turbo-Maschinen-AG Nüsse & Gräfer, Sprockhövel, Fed. Rep. of Germany

[21] Appl. No.: 437,456

[22] Filed: Nov. 15, 1989

[30] Foreign Application Priority Data

Nov. 18, 1988 [DE] Fed. Rep. of Germany ..... 3839007

[51] Int. Cl.[5] ..... E21B 3/02

[52] U.S. Cl. ..... 175/195; 74/665 B; 173/163; 475/5

[58] Field of Search ..... 175/170, 195, 113; 166/78; 173/104, 105, 163; 475/5, 317, 329, 330; 74/665 B, 665 C

[56] References Cited

U.S. PATENT DOCUMENTS

| | | | |
|---|---|---|---|
| 2,451,598 | 10/1948 | Wilson | 74/665 B |
| 3,330,164 | 7/1967 | Wilson | 74/333 |
| 3,503,281 | 3/1970 | Gsching et al. | 475/5 X |
| 4,732,218 | 3/1988 | Neumaier et al. | 173/105 |
| 4,815,546 | 3/1989 | Haney et al. | 173/163 X |

FOREIGN PATENT DOCUMENTS

| | | |
|---|---|---|
| 2114651 | 10/1971 | Fed. Rep. of Germany . |
| 3445492 | 10/1986 | Fed. Rep. of Germany . |

*Primary Examiner*—Ramon S. Britts
*Assistant Examiner*—David J. Bagnell
*Attorney, Agent, or Firm*—Michael J. Striker

[57] ABSTRACT

A drilling machine for drilling large drill holes in rock, especially underground, comprises a support, a rotary drilling drive longitudinally displaceable on the support in a drilling direction and provided with a reducing transmission and drive motors. The reducing transmission including a planetary transmission which is transmissively and selectively connectable with two of the drive motors as a superposed transmission.

13 Claims, 3 Drawing Sheets

3
7
6
4
5
8
9
1
II
2
10
44

DRILLING MACHINE FOR DRILLING LARGE DRILLING HOLES IN ROCK, PARTICULARLY UNDERGROUND

BACKGROUND OF THE INVENTION

The present invention relates to a drilling machine for drilling large drilling holes in rock, especially to be used underground. More particularly, it relates to a drilling machine which is provided with a rotary drilling drive having a reducing transmission and drive motors longitudinally displaceable on supports.

A drilling machine of the above mentioned general type is disclosed, for example, in the German document DE-AS 2,114,651 and also in the U.S. Pat. No. 3,330,164. In both drilling machines their drive motors with pinions cooperate with a common transmission gear and can be turned on and turned off as hydraulic motors hydraulically and when needed mechanically, for example, by claw couplings. Thereby the torque transmitted to the common transmission gear and its number of revolutions can be varied. However, such a multi-motor drive for drilling machines of the above mentioned type can be used only to a limited extent, since the effect of the rotary speed limit is very limited for hydraulic motors in the idle running. The parallel circuit in FIG. 6 of the German document DE-AS 2,114,651 provides the action of the respective switched off hydraulic motor as a pump, and it must be provided with a free running, that is however not well known and at high rotary speed can lead to cavitation problems. The further proposed coupling mechanical elements are structurally and operationally expensive, therefore experts skilled in the art have been very restrained in carrying such expenses in practice. Since furthermore with such drives the total drive energy must be hydraulically transmitted, one or several space consuming, heavy and expensive hydraulic aggregates are required. Such a multi-motor drive therefore has no significant advantage in view of the required hydraulic station.

Transmission-amplification drilling devices will find further utilization, especially the device in accordance with the German reference DE-PS 3,445,492 designed for relatively lighter drilling machines. Its drive output must be however significantly increased, and thereby with the known drive art very large and expensive hydraulic stations as compared with the drilling machine are needed.

SUMMARY OF THE INVENTION

Accordingly, it is an object of the present invention to provide a drilling machine of the above mentioned general type, which avoids the disadvantages of the prior art.

More particularly, it is an object of the present invention to provide a drilling machine which, with a limited drilling torque and average weight, is suitable for the drilling rods for target and enlargement drilling, on the one hand, and insures due to the special design of its drilling drive in cooperation with transmission-enlarging drilling devices, an efficient and especially economical enlargement to large drilling diameters.

In keeping with these objects and with others which will become apparent hereinafter, one feature of the present invention resides, briefly stated, in that a reducing transmission of a drilling machine is formed as a planetary transmission which is formed as a superposed transmission by transmissive (in transmission) or selective connection with two drive motors.

In accordance with the present invention, one drive motor can be formed as a hydraulic motor while another drive motor can be formed as an electric motor. Thereby the hydraulic motor can be used for required sensitivity during the frequent coupling processes of the short drilling rods underground, while to the contrary, by switching the electric motor through the superposed transmission an increase of the drive output can be achieved. This was achieved in the prior art only with help of hydraulic installations which were relatively large, expensive and heavy to transport. The increased drive output is converted not in an increased torque as was before, but instead in an increased number of revolutions of the transmission. Therefore, it can be transmitted to the drilling rods of an average weight. The increased number of revolutions of the transmission can be used in future transmission-enlarging drilling devices, whose high pressure requirement can be transmitted within wide limits by the drilling rods of an average height. In extreme cases the pressing can also be used by the enlargement drilling devices in accordance with the German reference DE-PS 3,445,492.

In accordance with the present invention it is possible to provide a universal large hole-rock drilling machine which is optimally designed for the basic functions, namely for producing the target holes and the first drilling hole-enlargements which can also be used for large enlargements in an efficient manner. For avoiding exceeding transportation, mounting and handling expenses, during a drilling process in accordance with the prior art for each drilling hole dimension between 1.5 and 5 m drilling hole diameter, it was necessary to maintain a special machine with respective drilling rods and at least two, in many cases three machines with a drive output which is between 90 kW to 300 kW.

An additional advantage of the invention is that only the rotary power for the main functions, for example 50 kW can be effectively achieved hydraulically, while the auxiliary power or great enlargements for example 100 kW can be achieved in exceptionally inexpensive manner structurally by an electric motor directly in the rotary drilling drive. For the first time with the inventive superposed transmission in a rotary drilling drive, such a mixing drive for motors is provided with considerably different drive characteristics.

In accordance with an advantageous embodiment of the invention, the superposed transmission includes a first planetary transmission stage with members which are concentrically centrically supported relative to the central axis of the transmission, namely central gears, and a planetary carrier, while the central gears are transmissively (in transmission) connected with different drive motors. In this construction the reducing transmission can be converted to operate as a superposing transmission without additional structural expenses.

Further in accordance with a further advantageous embodiment of the present invention, at least one of the drive motors, especially the larger electric motor, can have an angled longitudinal axis extending preferably perpendicularly to the drilling axis and connected through a bevel gear with the superposed transmission in a positive (transmitting)manner. Thereby the structural height of the rotary drilling drive and the drilling machine as a whole can be maintained very low, which is especially important for the underground use. Moreover, this arrangement of the electric motor facilitates mounting and dismounting in situ.

From German document DE-GM 8,800,989 it is known to provide a rotary-elastic damping coupling in a rotary drilling drive. This coupling is also proposed here and particularly between the auxiliary motor (here the electric motor) and the superposed transmission. For this case, it is advantageous in accordance with the present invention to provide the rotary-elastic coupling with a holding brake to achieve a structural simplification. The superposed transmission requires basically the fixation of the drive shaft of the non-used motor during operation of the other motor. Therefore, an electric motor in this case must be provided either with an integrated holding brake or with an additional holding brake.

For predrilling or target drilling with small drilling hole diameters, as well as for the first enlargement drilling, as a rule the drive power of the second motor is not required. For this reason, in accordance with an advantageous embodiment of the present invention the second drive motor, here the electric motor is removable, and a cover can be fixedly mounted on the transmission housing after the removal. The cover fixes the driven shaft against turning. With the use of an elastic coupling this can be achieved in an advantageous manner in that the cover has the same coupling parts as the drive disc remaining on the drive motor.

With this construction it is possible to avoid transportation and mounting of large electric motor with substantially doubled power of the hydraulic motor with a switching device for holes with small diameters, they can be mounted relatively fast after the performance of the predrilling. At the same time, the sensitivity of the hydraulic drive both for a coupling process of the drilling rods and for the damping action of the rotary-elastic coupling is obtained. The simultaneous availability of the holding brake on the elastic coupling is meaniful during the operation only with the hydraulic motor, when in accordance with the German document DE-GM 8,800,989 it is provided with a swinging mass and free run coupling for release of fixedly arranged drilling rods. The rotary percussion of this "loose braking device" will be kept from being swallowed by the inventive arrangement of the holding brake on the driven disc of the rotary-elastic coupling.

For achieving a required reduction for the significant class of drilling machines, it is desirable to provide the rotary drive with two planetary transmission stages arranged one after the other. In accordance with the present invention, the first planetary transmission stage is connected through its planetary carrier with the sun gear of the second planetary transmission stage for rotation therewith, and the planetary carrier of the second planetary transmission stage is connected with the drill chuck of the drilling machine in driving connection. This two-stage construction ensures an especially suitable gear shifting for obtaining higher rotary speeds in accordance with the present invention. For this purpose one of the two planetary transmission stages, as a rule the first planetary transmission stage, is formed as a superposed transmission and the other planetary transmission stage is formed as a switching transmission.

The hollow gear of the second planetary transmission stage is provided for this purpose with an outer toothing. During the concentric displacement relative to a central axis of the transmission, the second planetary transmission stage can be engaged by its outer toothing either with a stationary toothing of the transmission housing, or by its inner toothing with an outer toothing of the planetary carrier of the second planetary transmission stage. Since this simple gear shifting in one planetary transmission stage can be combined with difficultities with a superposed transmission, the two-stage transmission arrangement in the sense of the present invention is advantageous.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
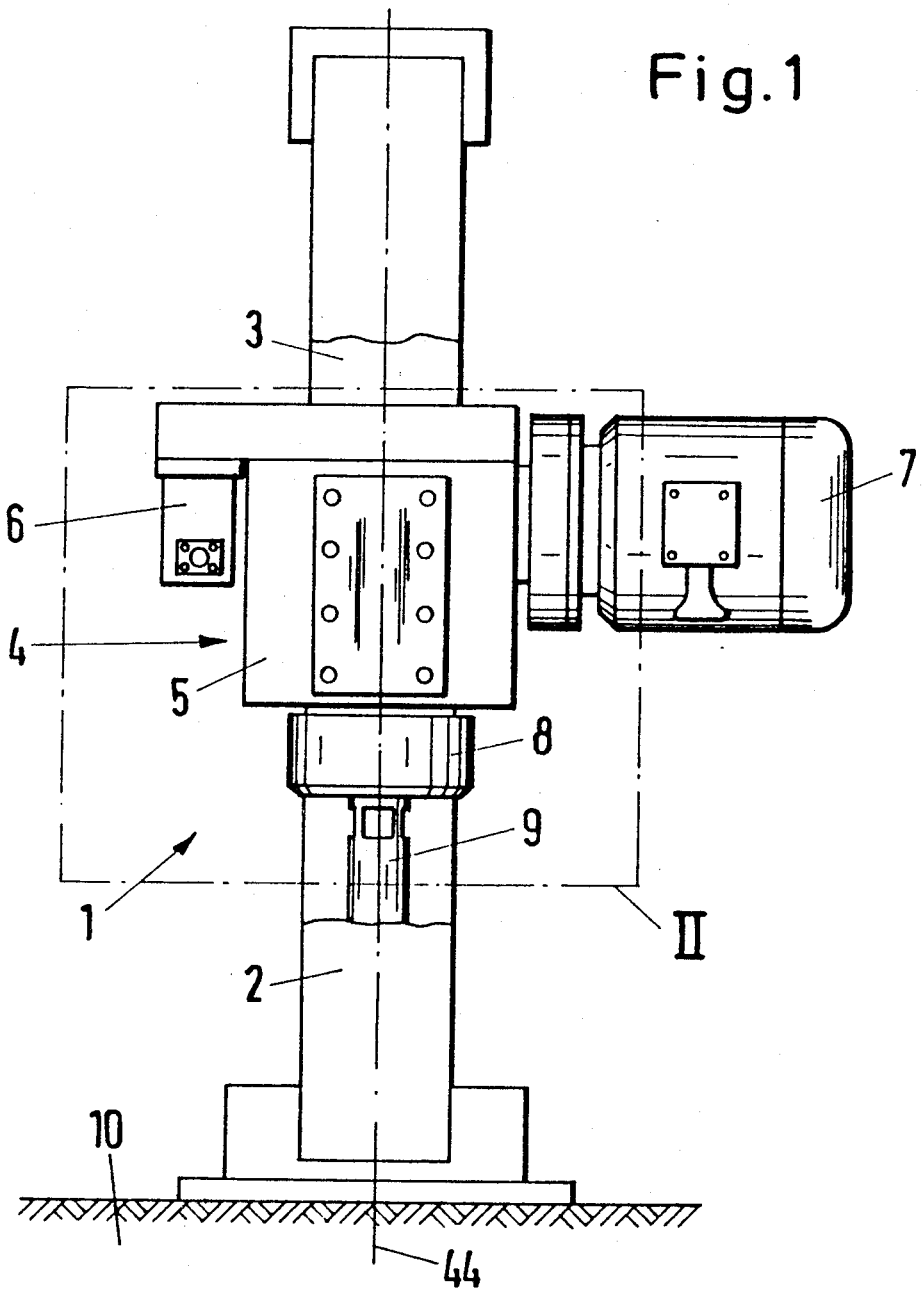
FIG. 1 is a side view of a drilling machine which drills downwardly and is provided with two supports.

A drilling machine is identified as a whole with reference numeral 1 and includes substantially two supports 2 and 3 and a rotary drilling drive 4 which is longitudinally displaceable between the supports. The rotary drilling drive 4 includes a reducing transmission 5, a hydraulic motor 6, an electric motor 7 and a drilling chuck 8. A first drilling rod 9 of the plurality of not shown drilling rods for drilling in a rock 10 is clamped in the drilling chuck.

Figure 2:
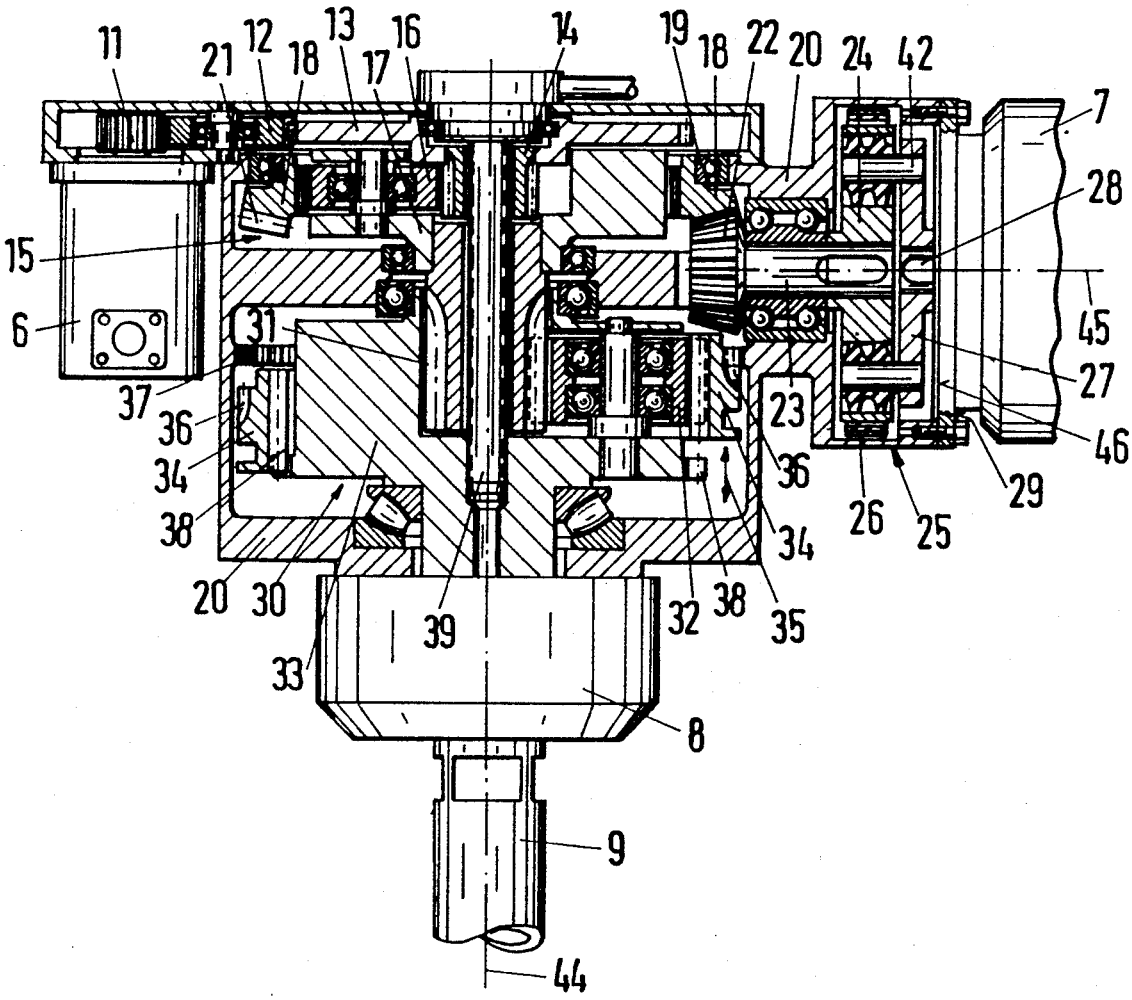
FIG. 2 is a view showing a fragment II of FIG. 1 in a longitudinal section and on an enlarged scale.

As can be seen from FIG. 2, the hydraulic motor 6 drives a spur gear 13 through a pinion 11 and an intermediate gear 12. The spur gear 13 is fixedly connected with a sun gear 14 of a first planetary transmission step 15. The first transmission step 15 also includes several, for example three, planetary gears 16 which mesh with the sun gear 14, the planetary carrier 17 and a hollow gear 18 which is supported by a bearing 19 rotatably in a transmission housing 20. The hollow gear 18 supports a bevel tooth 21 which meshes with a bevel pinion 22. A driven disc 24 is fixedly supported on the shaft 23 of the bevel pinion 22 for joint rotation therewith. The driven disc 24 forms a coupling disc of a rotary-elastic coupling 25 on the one hand, and serves as a braking disc for a braking band 26 on the other hand. A driving disc 27 of the rotary-elastic coupling 25 is arranged on a shaft trunnion 28 of the electric motor 7 for joint rotation therewith. The electric motor 7 is mounted on the transmission housing 20 by its motor flange 29.

The driveability of two central members independently of one another, namely of the sun gear 14 on the one hand, and the hollow gear 18 on the other hand, imparts this planetary transmission stage 15 the function of superposed transmission.

Furthermore, the transmission 20 accommodates a second planetary transmission stage 30. The latter includes substantially a second sun gear 31 which is permanently connected with the planetary carrier 17 of the first planetary transmission stage 15, several planetary gears 32, for example three, a second planetary carrier 33 and a second hollow gear 34. The hollow gear 34 is longitudinally displaceable in both directions of the double arrow 35 parallel and concentric to an axis 44 which forms simultaneously the transmission axis and the drilling axis.

Thereby the second planetary transmission stage 30 forms a switching stage. In the right half of FIGS. 2 and 3, the hollow gear 34 is shown in its upper switching position, in which it engages with its outer toothing 36 in a stationary inner toothing 37 of the transmission housing 20. In the so switched "slow running" of the drilling rod, the second planetary transmission stage 30 acts in addition to the first planetary transmission stage 15 in a reducing manner.

Figure 3:
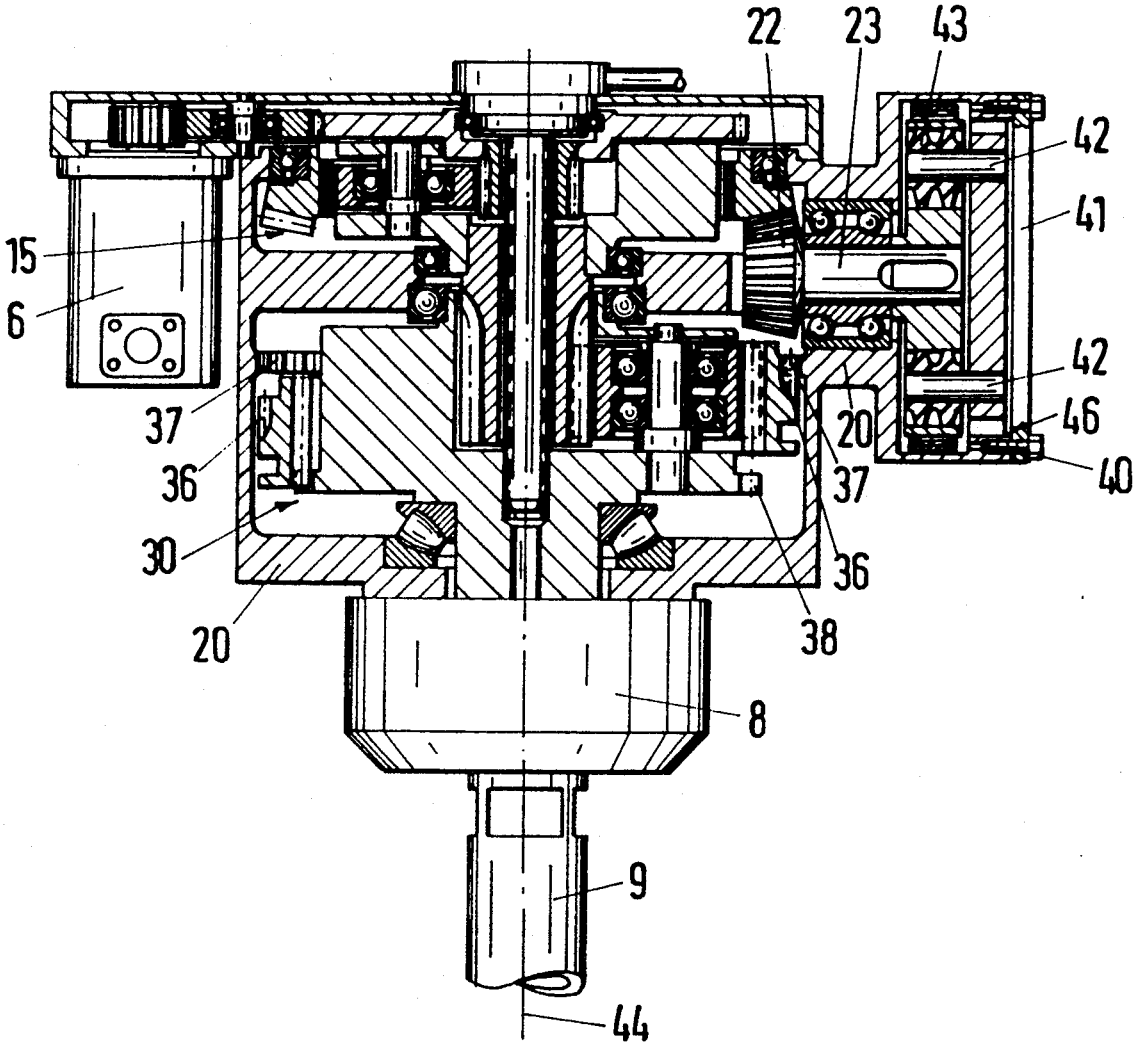
FIG. 3 is a view substantially corresponding to the view of FIG. 2, but showing the drilling machine with a removed electric motor and mounted cover with the same coupling parts as a drive disc of a rotary-elastic transmission on the drive motor.

In the left half of FIGS. 2 and 3, the hollow gear 34 is shown, to the contrary, in its lower switching position or so-called "fast running". Its outer toothing 36 is released, its inner toothing 37 is in engagement with an outer toothing 38 of the planetary carrier 39 of the second planetary transmission stage 30 and moreover, as before, in engagement with the planetary gears 32. Thereby this planetary gear stage 30 is rigid and transmits the rotation of the planetary carrier 17 of the first planetary transmission stage 15 without further reduction to the drilling chuck 8.

It can be recognized from the shown embodiment that at least with one angularly arranged auxiliary motor 7 via the bevel gears 21 and 22, in addition to the desired transmission, the transmission functions "superposing of both motor outputs" and "gear shifting" are distributed in an especially simple and space-economical manner on two planetary transmission stages 15 and 30. When the simultaneous driving of both motors 6 and 7 produces during the slow running switching an increased number of revolutions of the rod, then the fast running switching is useable so as to make available an increased number of revolutions, for example pre-drilling, with the hydraulic motor 6 and the detached electric motor 7. A rinsing pipe 39 for the drill rinsing centrally extends through both planetary transmission stages 15 and 30.

As can be seen from FIG. 3, in this embodiment the electric motor 7 is removed. A cover 41 is screwed with screws 40 on a flange 46 of the transmission housing 20 instead of the electric motor 7. The cover, as the driving disc 27 remaining on the electric motor 7 is provided with the rotary-elastic coupling 25 with pins 42 and damping bodies 43. The latter engage in the driven disc 24 of the rotary-elastic coupling 25. In this arrangement the shaft 23 and thereby the hollow gear 18 of the first planetary transmission stage 15 is hindered in its rotation, and simultaneously the damping action of the rotary-elastic coupling 25 is maintained for the drive incorporating the motor. It can be however switched off for breaking a drilling rod connection by pulling the braking band 26. The braking band 26 is also operative with the mounted electric motor 7.

The above shown embodiment makes clear that the present invention provides a rotary drilling drive which on the one hand can be used in exceptionally versatile manner and on the other hand is structurally very low and thereby enables a low structural height of the drilling machine. These features in addition with the cost reduction due to the relatively small hydraulic device, are of a great importance for underground utilization. In the shown case, the longitudinal axis 45 of the electric motor 7 extends at an angle of 90° relative to the transmission and drilling axes 44.

It is to be understood that the electric motor 7, when it is spatially advantageous, can also be mounted on transmission housing at a different angle.

Finally, it is also possible to arrange the stationary toothing 37 of the transmission housing 20 so that with the widened hollow gear 34 it engages in the switching stage shown in the right half of FIGS. 2 and 3, into the obligatory inner toothing.

It will be understood that each of the elements described above, or two or more together, may also find a useful application in other types of constructions differing from the types described above.

While the invention has been illustrated and described as embodied in a drilling machine for drilling large drill holes in rock, especially underground, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A drilling machine for drilling large drill holes in rock, especially underground, comprising a support; a rotary drilling drive longitudinally displaceable on said support in a drilling direction and provided with a reducing transmission and drive motors, said reducing transmission including a planetary transmission which is formed as a driving and selectively connectable with two of said drive motors as a superposed transmission; said planetary transmission having one planetary transmission stage which includes planetary members arranged concentrically relative to a transmission axis and a planetary carrier, two of said planetary members being drivingly connected with different ones of said drive motors, said planetary members being formed as central gears, one of said drive motors being pressure fluid-operating motor while the other of said drive motors is an electric motor.

2. A drilling machine as defined in claim 1, wherein at least one of said drive motors has a longitudinal axis which is inclined relative o a drilling axis of the drilling machine.

3. A drilling machine as defined in claim 2, wherein said one drive motor is transmissively connected with said superposed transmission; and further comprising a bevel gear connecting said one drive motor with said superposed transmission.

4. A drilling machine as defined in claim 3, wherein one drive motor is removable; and further comprising a transmission housing, and a cover mountable on said transmission housing after removal of said one drive motor so as to prevent rotation of said bevel gear.

5. A drilling machine as defined in claim 4, wherein said bevel gear has a shaft, said cover being mounted for preventing rotation of said shaft of said bevel gear.

6. A drilling machine as defined in claim 4, and further comprising a rotary-elastic coupling connecting said one drive motor with said superposed transmission and having coupling parts, cooperating with a driving disc of said one motor, said cover having said coupling parts when said one drive motor is removed.

7. A drilling machine for drilling large drill holes in rock, especially underground, comprising a support; a rotary drilling drive longitudinally displaceable on said support in a drilling direction and provided with a reducing transmission and drive motors, said reducing transmission including a planetary transmission which is formed as a driving and selectively connectable with two of said drive motors as a superposed transmission one of said drive motors being transmissively connected with said superposed transmission; and further comprising a rotary elastic coupling connecting said one drive motor with said superposed transmission.

8. A drilling machine as defined in claim 7, wherein said one drive motor is an electric motor.

9. A drilling machine as defined in claim 7, wherein at least one of said rotary-elastic coupling and said one drive motor is provided with a holding brake.

10. A drilling machine for drilling large drill holes in rock, especially underground, comprising a support; a rotary drilling drive longitudinally displaceable on said support in a drilling direction and provided with a reducing transmission and drive motors, said reducing transmission including a planetary transmission which is formed as a driving and selectively connectable with two of said drive motors as a superposed transmission; said planetary transmission having two planetary transmission stages arranged one after the other, each of said planetary transmission stages having a planetary carrier and a sun wheel; and further comprising a drilling chuck, one of said planetary transmission stages being fixedly connected through its planetary carrier with said sun wheel of the other of said planetary transmission stages, said planetary carrier of said other planetary transmission stage being in driving connection with said drilling chuck.

11. A drilling machine as defined in claim 10, and further comprising a transmission housing provided with a stationary toothing, a hollow gear of said other planetary transmission stage having a toothing which can be engaged with or disengaged from said stationary toothing of said transmission housing by a concentric movement parallel to a transmission axis.

12. A drilling machine as defined in claim 10, wherein said planetary carrier of said other planetary transmission stage has an outer toothing, a hollow gear of said other planetary transmission stage having an inner toothing, said outer toothing being engageable with and disengageable from said inner toothing.

13. A drilling machine for drilling large drill holes in rock, especially underground, comprising a support; rotary drilling drive longitudinally displaceable on said support in a drilling direction and provided with a reducing transmission and drive motors, said reducing transmission including a planetary transmission which is formed as a driving and selectively connectable with two of said drive motors as a superposed transmission; said planetary transmission including two planetary transmission stages and a rinsing pipe extending centrally through said both planetary transmission stages toward a drilling rod.

* * * * *